United States Patent [19]

Sinclair

[11] Patent Number: 4,531,795

[45] Date of Patent: Jul. 30, 1985

[54] EJECTOR SOCKET FOR DIP JUMPERS

[75] Inventor: William Y. Sinclair, Stockton, N.J.

[73] Assignee: Aries Electronics, Inc., Frenchtown, N.J.

[21] Appl. No.: 471,025

[22] Filed: Mar. 1, 1983

[51] Int. Cl.[3] ..... H01R 13/62

[52] U.S. Cl. ..... 339/45 M; 339/91 R

[58] Field of Search ..... 339/45, 46, 91 R

[56] References Cited

U.S. PATENT DOCUMENTS

| | | | |
|---|---|---|---|
| 3,728,664 | 4/1973 | Hurst | 339/91 R |
| 3,993,390 | 11/1976 | Eigenbrode | 339/91 R |
| 4,070,081 | 1/1978 | Takahashi | 339/91 R |
| 4,197,572 | 4/1980 | Aimar | 339/45 M |
| 4,341,428 | 7/1982 | Hatch et al. | 339/91 R |
| 4,435,033 | 3/1984 | Gansert et al. | 339/91 R |

FOREIGN PATENT DOCUMENTS

| | | | |
|---|---|---|---|
| 2082401 | 3/1982 | United Kingdom | 339/45 M |

*Primary Examiner*—Joseph H. McGlynn
*Assistant Examiner*—David L. Pirlot
*Attorney, Agent, or Firm*—Anthony J. Casella; Gerald E. Hespos

[57] ABSTRACT

An ejector socket for DIP jumpers is provided which includes a socket member and a pair of opposed latches. Each latch is pivotably mounted between a pair of locking arms which are disposed on opposed ends of the socket member. The locking arms cooperate with the respective latches to enable the latches to be lockingly retained in a position where the latches will securely maintain the DIP jumper in the subject ejector socket. The latches can be rotated out of their locked positions, thereby urging the DIP jumper out of the subject ejector socket. The socket member preferably is formed from a unitary piece of plastic.

7 Claims, 5 Drawing Figures

EJECTOR SOCKET FOR DIP JUMPERS

BACKGROUND OF THE INVENTION

A DIP jumper comprises a generally rectangular header constructed from an electrically nonconductive material such as plastic. Two parallel rows of terminal pins extend perpendicularly from the surface of the header. A flat cable extends from a second surface of the header. The flat cable includes a plurality of wires which extend into the header and connect to the terminal pins. The flat cable then extends from the header to another header.

DIP jumpers typically are used to connect one circuit board to another. The circuit boards have DIP sockets mounted thereon, each of which includes a plurality of apertures corresponding to the terminal pins on the DIP jumper. The terminal pins on the DIP jumper are inserted into the apertures on the DIP socket, thereby making a frictional and electrical connection.

Many environments in which DIP jumpers are employed are characterized by a substantial amount of vibrations. These vibrations can cause the DIP jumper to "walk" out of the socket, thereby destroying or impairing the electrical connection. Many applications of DIP jumpers also require frequent removal or replacement of the DIP jumper. Since both the DIP jumpers and the DIP sockets often are quite small, it frequently is difficult to properly grasp the DIP jumper to remove it from the socket. As a result, the DIP jumpers and DIP sockets often are damaged as they are being separated from one another.

To better accommodate the retention of DIP jumpers in DIP sockets in high frequency environments, and to facilitate the removal of DIP jumpers from DIP sockets, DIP ejector sockets have been developed. Prior art DIP ejector sockets have included a pair of C-shaped latches hingedly mounted on opposed ends of the socket. Each C-shaped latch on the prior art DIP ejector socket includes ejector and retaining legs extending perpendicularly from opposed ends of a base. The C-shaped latches are hingedly connected to opposed ends of the prior art DIP socket such that each C-shaped latch can pivot about the connection between its ejector leg and base. More particularly, the C-shaped latches are hingedly mounted on opposed ends of the prior art DIP socket such that the open portions of each C-shaped latch face one another.

The C-shaped latches of the prior art ejector sockets hingedly rotate from a position for retaining the DIP jumper to a position for ejecting the DIP jumper. In their retaining position, the base of each C-shaped latch is perpendicular to the plane of the socket and parallel to the pins on the DIP jumper. In this retaining position the ejector leg of each C-shaped latch is parallel and adjacent to the surface of the DIP jumper header from which the termianl pins extend. The retaining leg of each C-shaped latch is adjacent and in contact with the surface of the DIP jumper header opposite the terminal pins. This contact of the C-shaped latches with the DIP jumper retains the DIP jumper in the socket.

The C-shaped latches of the prior art ejector sockets are rotated into their ejector position by urging the retaining legs away from one another thereby causing the ejector legs to move upwardly and away from the plane of the DIP socket. This movement of the ejector legs out of the plane of the socket urges the DIP jumper out of the DIP socket, thereby facilitating removal and replacement of the DIP jumper.

Despite the advantages of the prior art ejector sockets for DIP jumpers, the need for improvements have been noted. Specifically the means used on prior art ejector sockets to lock the C-shaped latches into their retaining position have been costly and difficult to manufacture, and have been subject to malfunction after repeated use. In the prior art ejector sockets for DIP jumpers a separate plastic strip has been used to perform this locking function. More particularly, the prior art ejector socket includes at least five separate parts including: two C-shaped latches, a board mounting member, a jumper retaining member and a locking strip. The board mounting member includes the leads which are electrically connected to the circuit board. The jumper retaining member includes apertures to accept the pins on the DIP jumper, and includes the pair of C-shaped latches hingedly mounted thereon. The jumper retaining member is mounted on the side of the board mounting member opposite the circuit board, and is configured to provide an elongated centrally located channel therebetween. The locking strip is disposed in the elongated centrally located channel between the jumper retaining member and the board mounting member.

When the C-shaped latches are in their retaining position, the locking strip is disposed in face to face contact with a portion of each ejecting leg on the outer perimeter of the C-shaped latch. This contact between the locking strip and the ejector leg of the C-shaped latch keeps the C-shaped latch in proper position to retain the DIP jumper. However, when the C-shaped latch is rotated into its ejector position the outermost corner of the C-shaped latch, as defined by the intersection of the ejecting leg and the base, is urged into contact with a locking strip causing the locking strip to bend toward the board and away from the DIP jumper.

The prior art ejector sockets described herein are difficult and expensive to manufacture and assemble because of the many parts included therein. Specifically, the need to manufacture and assemble separate board mounting members, retaining members and locking strips results in a complex time consuming assembly process. Additionally, the ability of the ejector socket to lockingly retain the DIP ejector is largely dependent on the ability of the locking strip to retain its resiliency over repeated uses. It has been found, however, that after many uses the relatively small locking strip of the prior art ejector socket can lose its resilient characteristics thereby enabling the DIP jumper to vibrate loose from the socket. Attempts to manufacture the various components of the prior art ejector socket to more securely lock the DIP jumper in the socket have resulted in sockets requiring a greater force to urge the C-shaped latches away from one another. This greater force can result in damage to the jumper retaining leg of the C-shaped latch.

Accordingly, it is an object of the subject invention to provide an ejector socket for DIP jumpers that will securely retain the DIP jumper therein.

It is another object of the subject invention to provide an ejector socket for DIP jumpers that can readily facilitate the removal of the DIP jumper therefrom.

It is a further object of the subject invention to provide an ejector socket for DIP jumpers that maintains its locking ability even after repeated usage.

It is still another object of the subject invention to provide an ejector socket for DIP jumpers that is not likely to break or become damaged during use.

It is still an additional object of the subject invention to provide an ejector socket for DIP jumpers that can be manufactured from fewer parts.

It is yet a further object of the subject invention to provide an ejector socket for DIP jumpers that can be manufactured and assembled with less costs and with greater ease than the known prior art ejectors.

SUMMARY OF THE INVENTION

The subject ejector socket for DIP jumpers includes a socket member and a pair of generally C-shaped latches hingedly connected to the socket member. The socket member preferably is of unitary construction, and includes a generally rectangular base having opposed top and bottom surfaces, front and rear edges and opposed end edges. Socket apertures extend through the base from the top surface to the bottom surface in an array of two parallel lines disposed adjacent and parallel to the front and rear edges. The base typically is formed from plastic, but includes electrically conductive sockets mounted in the socket apertures. Each socket includes a pin receiving portion having an opening adjacent the top surface of the base, and a lead extending from the bottom surface of the base. The leads typically extend through the circuit board with which the ejector socket is used, and are electrically connected to other parts of the circuit. The socket member further includes two pairs of locking arms. The locking arms are spaced from each other and extend from the base such that one pair of locking arms is adjacent each of the opposed end edges of the base. The base of the socket member further includes substantially rectangular recesses extending into the top surface. Each recess is located centrally between the front and rear edges of the base and adjacent an end edge of the base.

Each C-shaped latch of the subject ejector socket includes an elongated locking member, a retaining member extending perpendicularly from one end of the locking member, and an ejecting member extending perpendicularly from the opposed end of the locking member. The C-shaped latches are hingedly mounted on the socket member such that each C-shaped latch may be rotated between first and second positions. In the first position the ejecting member of the C-shaped latch is disposed in the rectangular recess in the base of the socket member, and the locking member of the C-shaped latch is between the locking arms of one pair of locking arms which extend from the socket members. Rotation of each C-shaped latch into the second position causes the ejecting member of each latch to pivot upward and away from the base of the socket member, and also causes the locking member to move out of its position between the locking arms. Thus the C-shaped latches retain the header of the DIP jumper in the subject socket when the C-shaped latches are in the first position. Conversely, the ejecting members of the C-shaped latches eject the DIP jumper from the subject socket as the C-shaped latches are rotated to their second position.

To lockingly maintain the C-shaped latches in their retaining position, the locking member of each C-shaped latch includes a pair of bosses disposed on the sides thereof adjacent the locking arms. The locking arms each include a groove positioned and dimensioned to accept the corresponding boss on the C-shaped latch. Each locking arm further includes an elongated notch. The notches are disposed along planes substantially parallel to the front and rear edges of the base, and extend toward the base from a point on each locking arm most distant from the base. These notches, each define a resilient finger one side of which includes the groove into which a boss on the C-shaped latch may be moved. Thus, as the C-shaped latches are pivoted into their retaining position, the bosses contact the resilient fingers on the locking arms and cause the resilient fingers to bend slightly away from the C-shaped latch. Additional rotation of the C-shaped latches towards one another will cause the bosses to snap into their respective grooves, thereby enabling the resilient fingers to return to their unbiased position and lockingly maintaining the C-shaped latches in their retaining position. This cooperation between the bosses on the C-shaped latches and the grooves on the resilient fingers eliminates the need to have a separate board mounting member and locking strip, and further enables a socket member of unitary construction. This structure is easier to manufacture and more reliable in use.

The efficiency of the subject ejector socket is further enhanced by incorporating ribs into the surface of the C-shaped latch retaining member on the side thereof opposite the locking member. This ribbed configuration facilitates the grasping of the retaining member by the user, thus enabling the retaining member to be constructed somewhat smaller. This smaller size saves material and reduces the torque imposed on the retaining member, thereby minimizing the possibility of having the retaining member break.

The subject ejector socket further may be provided with a pair of rails extending from the top surface of the base and parallel to the front and rear edges. These rails can be easily formed to different sizes thereby enabling the subject ejector socket to securely retain DIP jumpers of varying sizes without entirely redesigning the various components of the subject ejector socket.

DETAILED DESCRIPTION OF THE PREFERRED EMBODIMENT

Figure 1:
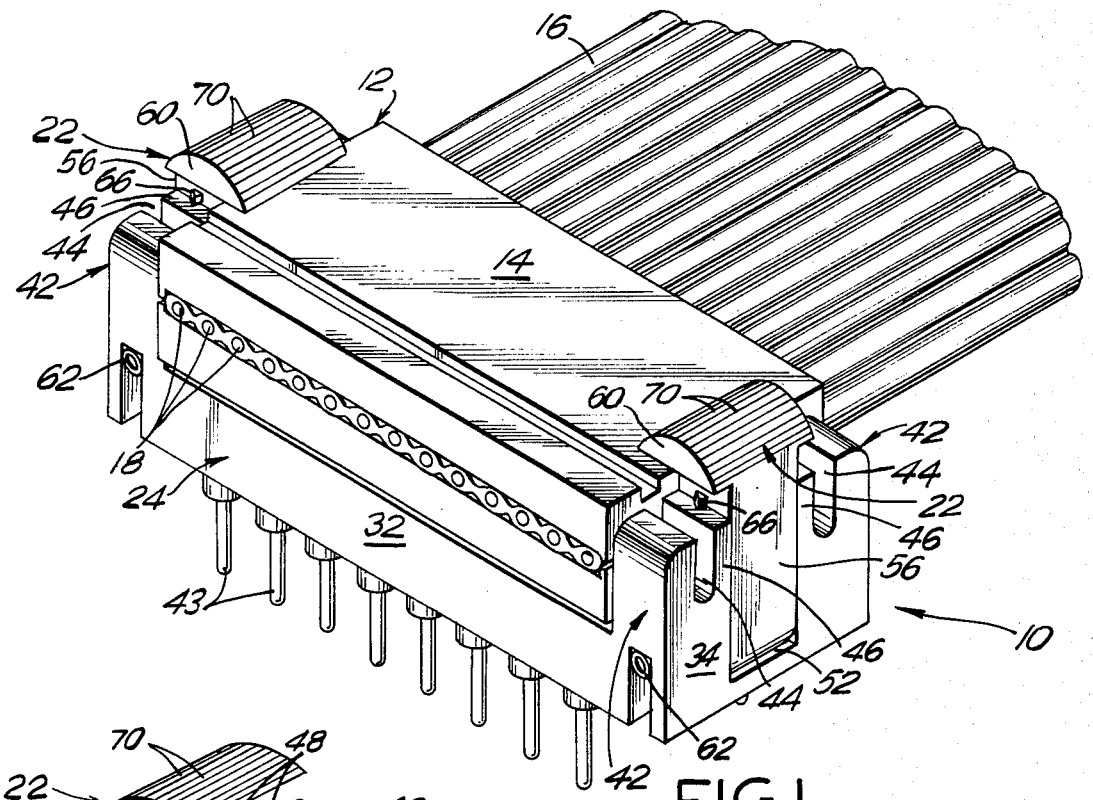
FIG. 1 is a perspective view of the subject ejector socket lockingly retaining a DIP jumper.

Referring to FIG. 1, the ejector socket 10 of the subject invention is formed from an electrically non-conductive material such as plastic, and is adapted to lockingly retain a DIP jumper 12. The DIP jumper 12 includes an electrically non-conductive header 14 into which a flat cable 16 extends. The flat cable 16 includes a plurality of electrically conductive wires 18, each of which extends to a terminal pin (now shown). The terminal pins of the DIP jumper 12 extend perpendicularly from one surface of the header 14, and are disposed in two parallel rows.

The ejector socket 10, as shown more clearly in FIGS. 2 through 5 includes a socket member 20 and a pair of latches 22. The socket member 20 is of unitary construction, and includes opposed top and bottom surfaces 26 and 28, opposed front and rear edges 30 and 32, and opposed end edges 34 and 36.

A plurality of electrically conductive sockets 38 are mounted in the socket member 20 and extend therethrough from the top to bottom surfaces 26 and 28. Each socket 38 includes a female end 40 and male end 42. The female end 40 of each socket 38 is disposed adjacent the top surface 26, and defines the portion of each socket 38 into which the terminal pins of the DIP jumper 12 are inserted. The male end 43 of each socket 38 extends from the bottom surface 28 of the socket member 20, and defines the portion of each socket 38 that is electrically connected to a circuit board.

The socket member 20 further includes four locking arms 42 which extend perpendicularly from the top surface 26. Two locking arms 42 are disposed adjacent end edge 34, whereas the other two locking arms 42 are disposed adjacent end edge 36. The locking arms 42 at each end edge 34 and 36 are spaced from one another by distance A as indicated most clearly in FIGS. 3 and 5. Each locking arm 42 is characterized by an elongated notch 44 which extends toward top surface 26 from the end of locking arm 42 furthest from the top surface 26. Additionally, each notch 44 extends in a plane substantially parallel to the front and rear edges 30 and 32.

Each notch 44 defines a resilient finger 46 on its respective locking arm 42. The face of the resilient finger 46 opposite notch 44 includes a groove 48 which preferably is of a generally V-shape. As explained further below the resilient fingers 46 of the respective locking arms 42 cooperate with the latches 22 to lockingly retain the DIP jumper 12 in the ejector socket 10.

As noted above, the ejector socket 12 is formed from an electrically nonconductive material. When the ejector socket 10 is formed from a thirty percent glass filled polyester, it has been found that a notch 44 having depth B equal to 0.100 inches with a width C equal to 0.035 inches and a resilient finger 46 with a width D of 0.040 inches performs well. Additionally, the V-shaped notch 48 in the resilient finger 46 formed to an approximate depth of 0.007 inches has proved functional.

Figure 2:
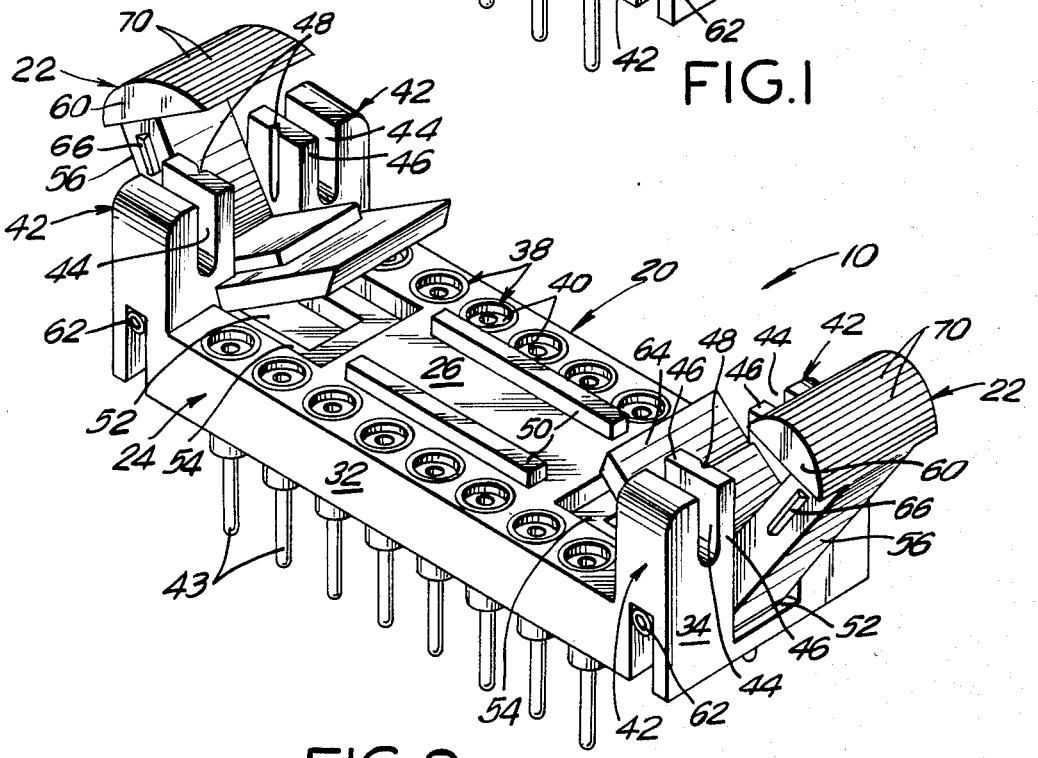
FIG. 2 is a perspective view of the ejector socket shown in FIG. 1 with the DIP jumper removed therefrom.
Figure 3:
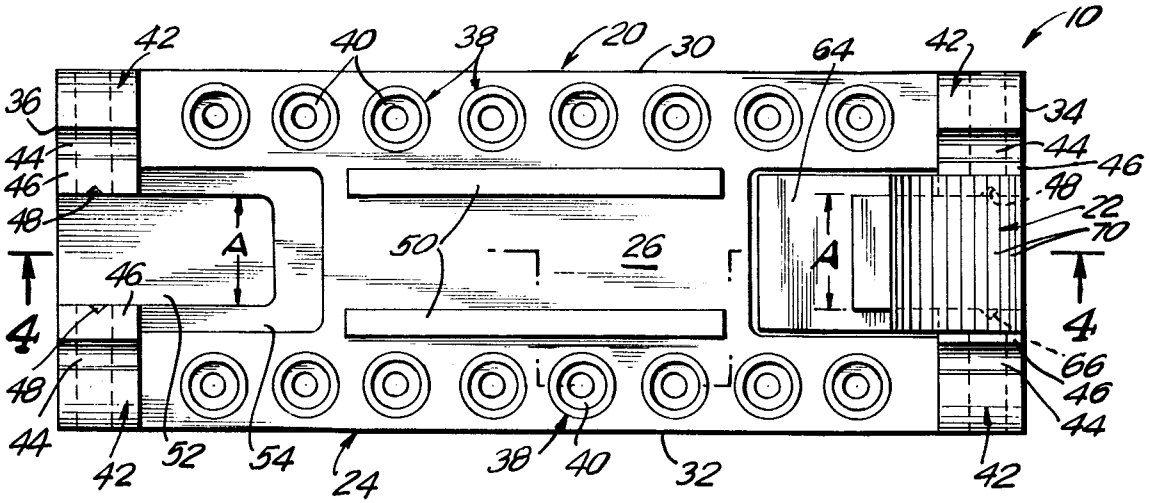
FIG. 3 is a plan view of the subject ejector socket.
Figure 4:
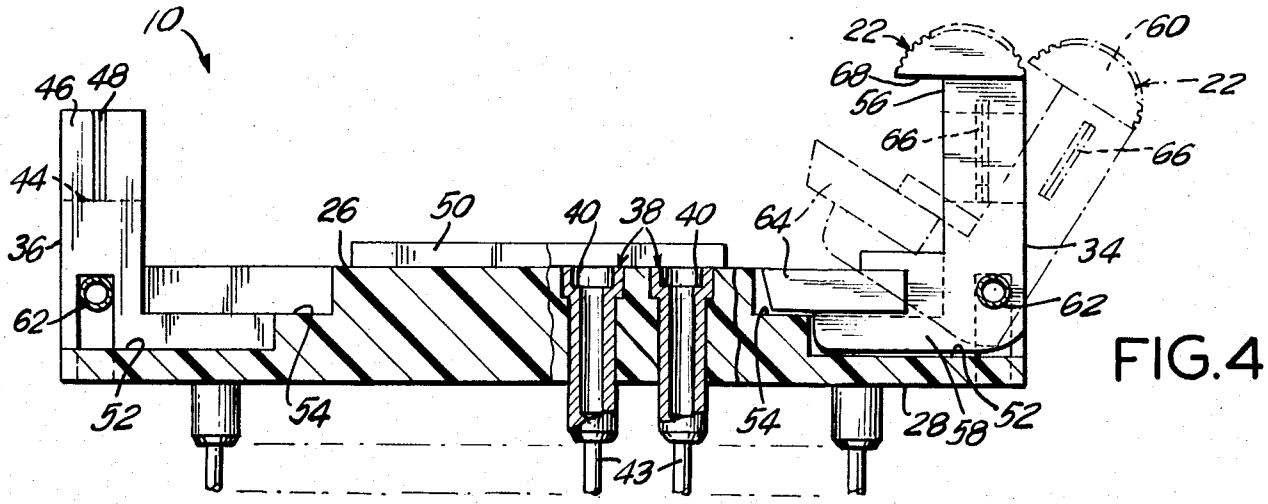
FIG. 4 is a cross-sectional view taken along line 4—4.

As illustrated in FIGS. 2, 3 and 4, the top surface 26 of the base 24 includes rails 50 which extend parallel to the front and rear edges 30 and 32 of base 24. The rails 50 function as a seat for the DIP jumper 12, ensuring that the DIP jumper 12 is properly retained in the ejector socket 10. More particularly, the rails 50 may be formed to any specified height, with the particular height being selected to reflect the dimensions of the DIP jumper header 14. Thus, as explained further below, the DIP jumper header 14 can be securely retained between the rails 50 and the latches 22.

The top surface 26 of the socket member 20 is further defined by recesses 52 which are centrally disposed between the front and rear edges 30 and 32 and adjacent the end edges 34 and 36 respectively. The recesses 52 each have a width A substantially equal to the distance between the resilient locking arms 42. An ejector seat 54 is defined by a generally rabbeted groove adjacent the recess 52 and top surface 26 of base 24. As noted further below, and as shown in FIG. 4, a portion of each latch 22 fits into the ejector seat 54 when the latch 22 is in position to lockingly engage the DIP jumper 12.

Each latch 22 includes an elongated locking member 56, an ejecting member 58 and a retaining member 60. The ejecting member 58 and the retaining member 60 each extend generally perpendicularly from opposed ends of the locking member 56. Each latch 22 is pivotably mounted between a pair of locking arms 42. More particularly, rod 62 extends through one locking arm 42, through the portion of latch 22 where locking and ejecting members 56 and 58 meet, and finally through the corresponding locking arm 42. In this manner, the latch 22 can hingedly rotate with respect to the socket member 20.

Figure 5:
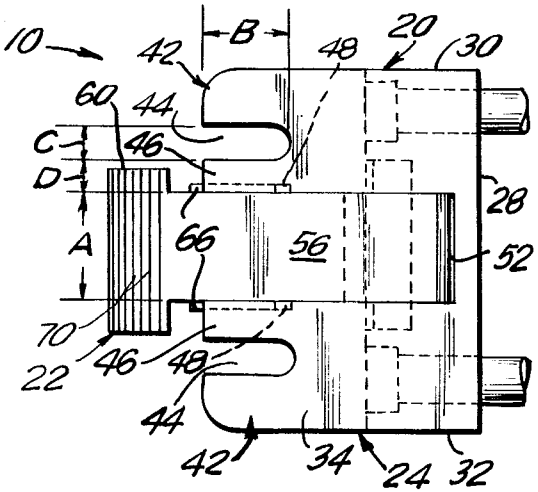
FIG. 5 is an end view of the ejector socket shown in FIG. 3.

As shown most clearly in FIG. 4, an ejecting platform 64 is mounted on the ejecting member 58. The ejecting member 58 and the ejecting platform 64 are dimensioned to be seated respectively in the recess 52 and the ejector seat 54 of the socket member 20. The locking member 56 has a width A substantially equal to the distance between the locking arms 42, as illustrated in FIG. 5. The surfaces of each locking member 56 adjacent the respective locking arms 42 each are provided with generally wedge shaped bosses 66. Each boss 66 has a configuration substantially indentical to the grooves 48 in the resilient fingers 46.

The retaining member 60 of each latch 22 is of substantially semi-cylindrical configuration, wherein the generally rounded portion thereof is facing generally away from the ejecting member 58. Retaining member 60 includes a retaining surface 68 which is substantially orthogonal to locking member 56. The arcuate surface of the retaining member 60 is defined by a plurality of ribs 70, which facilitate the grasping of latches 22 by the user of the subject ejector socket 10.

Prior to use, the subject ejector socket 10 is mounted on a circuit board and the latches 22 are hingedly rotated into the approximate position shown in FIG. 2. The DIP jumper 12 then is positioned with respect to the ejector socket 10 such that the terminal pins of the DIP jumper 12 are aligned with the female ends 40 of the sockets 38. As the DIP jumper 12 is advanced into the ejector socket 10, the force of the header 14 against the ejecting members 58 of latches 22 causes the latches 22 to rotate into the approximate position shown in FIG. 1. As the latches 22 rotate toward the position shown in FIG. 1, each locking member 56 will slidably enter the space between locking arms 42. The bosses 66 effectively add to the width of the locking member 56. Consequently, as the latches 22 are pivoted toward one another, the bosses 66 will contact the resilient fingers 46. After this initial contact of each boss 56 with its corresponding finger 46, additional forces exerted either upon DIP jumper 12 or upon latches 22 will cause each resilient finger 46 to be biased away from its respective latch 22. Biasing the resilient finger 46 effectively increases the distance between the locking arms 42, thereby enabling portions of locking members 56 having bosses 66 to advance between the resilient fingers 46. Continued rotation of latches 22 about rods 62 causes bosses 66 to enter grooves 48, as shown most clearly in FIG. 1. As the bosses 66 enter the respective grooves 48, the biasing force on the resilient fingers 46 will be stopped, and the resilient fingers 46 will return to their initial unbiased position thereby lockingly engaging bosses 66 in the grooves 48.

In the locked position described above, the retaining surface 68 of each retaining member 60 will be adjacent the header 14 of DIP jumper 12. The contact between the retaining surface 68 and DIP jumper 12 will ensure that the DIP jumper 12 will not vibrate loose or "walk" out of the subject ejector socket 10.

To remove the DIP jumper 12 from the ejector socket 10, the user urges the retaining members 60 away from one another. Typically, this is accomplished by placing both thumbs on the ribs 70 of the respective retaining members 60 and exerting an appropriate pressure on the retaining members 60 away from one another. This initial pressure on retaining members 60 causes the bosses 66 to exert a biasing force on the grooves 48. Due to the generally V-shaped configuration of both the bosses 66 and grooves 48, the forces exerted on the retaining members 60 causes the resilient fingers 46 adjacent each locking member 56 to be biased away from one another. This biasing movement of resilient fingers 46 effectively increases the distance therebetween, enabling the bosses 66 to slidably advance between the locking arms 42. A sufficient rotation of latches 22 in this manner will cause the bosses 66 to clear the locking arms 42, thereby enabling resilient fingers 46 to return to their initial unbiased position.

The movement of the retaining members 60 away from one another causes the ejecting member 58 and the ejecting platform 64 of each latch 22 to move upward and out of the plane of the top surface 26. This upward movement of retaining members 60 exerts a force on the header 14 which causes the terminal pins on the DIP jumper 12 to be slidably removed from the sockets 38.

In summary, an ejector socket is provided which includes a socket member of unitary contruction and a pair of latches. The latches each are pivotably mounted between a pair of locking arms. Each locking arm includes a notch which defines a resilient finger. The resilient fingers each include a groove on the surface thereof opposite the notch. The latches are defined by an elongated locking member and ejecting and retaining members extending perpendicularly from opposed ends of the locking member. The locking members each include a pair of bosses which are dimensioned and located to be cooperatively received by the grooves in the resilient fingers. Latches are mounted with respect to the socket member such that the locking members may be rotated into a position between the resilient fingers thereby enabling the bosses to be lockingly engaged in the grooves on the resilient fingers. This cooperation between the bosses on the locking member and the grooves on the resilient fingers ensures that the DIP jumper will be securely retained in the subject ejector socket by the retaining member of the latches. Each retaining member further includes a plurality of ribs which facilitate the disengagement of the DIP jumper from the subject ejector socket. The socket member further includes a pair of rails which are dimensioned to enable the subject ejector socket to accept DIP jumpers of various dimensions without requiring substantial design changes to the subject ejector socket.

What is claimed is:

1. An ejector socket for a DIP jumper comprising:

a generally rectangular socket member including opposed top and bottom surfaces and socket apertures extending therebetween, opposed generally planar front and rear surfaces extending between said top and bottom surfaces, and opposed first and second ends, said socket member further including first and second pairs of spaced apart arms extending upwardly from said top surface, said first and second pairs of arms being disposed respectively adjacent the first and second ends of said socket member, one arm in each said pair of arms being adjacent the front surface of said socket member and the other arm in each said pair being adjacent the rear surface thereof, said socket member further including first and second pairs of spaced apart resilient fingers disposed intermediate the arms of said first and second pairs of arms respectively, each said resilient finger being generally parallel to and spaced from at least a portion of the arms in the respective first and second pairs of arms such that the resilient fingers in each said pair can be biasingly urged away from one another and toward one said arm in the respective first and second pairs of arms, each said resilient finger including a locking groove on the side thereof nearest the other resilient finger in its respective pair; and first and second latches, each said latch including an elongated locking member and ejecting and retaining members extending generally perpendicularly from opposed ends of said locking member, said locking member including a pair of bosses dimensioned and located to be received in said locking grooves, said latches being pivotably mounted with respect to said first and second pairs of resilient fingers such that each said latch may be rotated between first and second positions, such that in said first position said locking member is disposed intermediate its respective pair of locking arms, and the locking bosses thereof are frictionally and lockingly engaged by said locking grooves and with the ejecting member of said latch being substantially parallel to said top surface of said socket member, and such that in said second position said ejecting member extends angularly from said top surface, whereby the arms of said ejector socket protect the DIP jumper mounted therein from inadvertent contact and whereby the resilient fingers biasingly move to engage the respective latches for lockingly holding the DIP jumper in the ejector socket.

2. An ejector socket as in claim 1 wherein each said boss and each said locking groove is generally V-shaped.

3. An ejector socket as in claim 1 wherein the retaining member on each said latch includes a retaining surface for lockingly retaining an electrical connector in said ejector socket.

4. An ejector socket as in claim 1 wherein said socket member is of unitary construction.

5. An ejector socket as in claim 1 wherein the top surface of said socket member includes at least one rail, said rail defining a surface upon which an electrical connector may be seated.

6. An ejector socket as in claim 1 wherein a portion of each said retaining member opposite its respective locking member is defined by a plurality of ribs extending generally parallel to the axis about which each said latch pivots.

7. An ejector socket as in claim 6 wherein the ribbed surface of said retaining member is convexly arcuate.

* * * * *